US005792318A

United States Patent [19]

Mancini

[11] Patent Number: 5,792,318

[45] Date of Patent: Aug. 11, 1998

[54] METHOD TO STABILIZE SHEET BETWEEN PRESS SECTION AND DRYER SECTION OF A PAPER-MAKING MACHINE

[76] Inventor: Ralph Mancini, 970 Montee de Liesse, Suite 201, Ville St.-Laurent, Quebec H4T 1W7, Canada

[21] Appl. No.: 901,556

[22] Filed: Jul. 20, 1997

Related U.S. Application Data

[63] Continuation of Ser. No. 794,446, Feb. 4, 1997, abandoned.

[30] Foreign Application Priority Data

Nov. 18, 1996 [CA] Canada ..... 2190563

[51] Int. Cl.[6] ..... D21F 2/00

[52] U.S. Cl. ..... 162/193; 226/973

[58] Field of Search ..... 162/202, 207, 162/193, 194, 306, 358.1, 361; 226/97.1, 97.2, 97.3; 34/114, 115, 116

[56] References Cited

U.S. PATENT DOCUMENTS

| | | | |
|---|---|---|---|
| 3,367,035 | 2/1968 | Tomlinson | 34/10 |
| 3,753,298 | 8/1973 | Ely | 34/116 |
| 3,764,085 | 10/1973 | Hawkins | 242/526.3 |
| 3,861,996 | 1/1975 | Dorfel | 162/274 |
| 3,874,997 | 4/1975 | Kankaanpaa | 162/290 |
| 4,016,032 | 4/1977 | Kankaanpaa | 162/305 |
| 4,074,841 | 2/1978 | Kramer et al. | 226/97.3 |
| 4,194,947 | 3/1980 | Huostila et al. | 162/207 |
| 4,247,993 | 2/1981 | Lindstrom | 34/156 |
| 4,321,107 | 3/1982 | Page | 162/198 |
| 4,359,828 | 11/1982 | Thomas | 34/114 |
| 4,414,757 | 11/1983 | Whipple | 34/155 |
| 4,440,598 | 4/1984 | Koski et al. | 162/305 |
| 4,502,231 | 3/1985 | Fissmann | 34/114 |
| 4,539,762 | 9/1985 | Eskeline et al. | 34/114 |
| 4,551,203 | 11/1985 | Eskiline | 162/202 |
| 4,628,618 | 12/1986 | Virta et al. | 34/116 |
| 4,686,777 | 8/1987 | Cooke | 34/116 |
| 4,694,587 | 9/1987 | Eskelinen | 34/23 |
| 4,698,919 | 10/1987 | Wedel | 34/117 |
| 4,875,976 | 10/1989 | Wedel | 162/306 |
| 4,891,891 | 1/1990 | Wedel | 34/23 |
| 4,953,297 | 9/1990 | Eskelinen et al. | 34/23 |
| 4,986,009 | 1/1991 | Haessner et al. | 34/23 |
| 5,022,166 | 6/1991 | Nguyen et al. | 34/120 |
| 5,074,278 | 12/1991 | Turcotte | 34/23 |
| 5,379,526 | 1/1995 | Haverinen | 34/114 |

FOREIGN PATENT DOCUMENTS

| | | |
|---|---|---|
| 1184377 | 3/1985 | Canada . |
| 1192738 | 9/1985 | Canada . |
| 1243197 | 10/1988 | Canada . |
| 1247857 | 1/1989 | Canada . |
| 1251635 | 3/1989 | Canada . |
| 1252288 | 4/1989 | Canada . |
| 1274978 | 10/1990 | Canada . |
| 1299865 | 5/1992 | Canada . |
| 1307107 | 9/1992 | Canada . |
| 1317807 | 5/1993 | Canada . |
| 1319011 | 6/1993 | Canada . |
| 1329710 | 5/1994 | Canada . |
| 2118305 | 9/1994 | Canada . |
| 2118307 | 9/1994 | Canada . |
| 1336535 | 8/1995 | Canada . |
| 1336536 | 8/1995 | Canada . |

*Primary Examiner*—Stanley S. Silverman
*Assistant Examiner*—Jose S. Fortuna
*Attorney, Agent, or Firm*—Martin J. Marcus

[57] ABSTRACT

A novel sheet transfer stabilizer is provided for transferring a fibrous wet sheet from a press section to a dryer section of a paper-making machine by way of a felt, or the like. The sheet transfer stabilizer includes a composite Venturi box which is disposed between a felt roll of the press section and a first dryer. The Venturi box includes three side-by-side Venturis, namely an inlet Venturi, an outlet Venturi, and a main Venturi, such Venturi boxes are used to create and maintain a vacuum in the felt/web system.

12 Claims, 3 Drawing Sheets

METHOD TO STABILIZE SHEET BETWEEN PRESS SECTION AND DRYER SECTION OF A PAPER-MAKING MACHINE

This application is a continuation of application Ser. No. 08/794,446, filed on Feb. 04, 1997, now abandoned.

BACKGROUND OF THE INVENTION

1. Field of the Invention

This invention relates to a device and method to stabilize a sheet between the press section and the dryer section of a paper machine. More particularly, the present invention is directed to such an apparatus and method for guiding a fibrous web from a press section to a drying section, in which the web is guided and supported on a drying felt wire as the web is guided into the drying section, e.g., around an initial group of drying cylinders.

2. Description of the Related Art

After pressing, a fibrous web, e.g., a paper web prepared in a paper machine, is extremely weak. A large number of breaks in the web tend to occur in the run thereof between the press section and a first drying cylinder within a drying section.

The prior art is familiar with a press section which comprises a closed roll combination having four press rolls, in which the first nip was formed between a hollow-faced roll and a suction roll, and was provided with two pressing felts. The second single-felt nip of the press section was formed between the suction roll and a centre roll of the press section. The centre roll of the press section was a smooth-faced stone roll, the third, final, nip of the press section being formed in connection with this stone roll and being provided with its own felt. The running fibrous web was detached from the smooth face of the stone roll in the press section by extending or stretching the web in the running direction.

In recent years the running speeds of paper machines have been increasing constantly up to 1500 meters per minute. At such speeds, fluttering of the web becomes a serious problem deteriorating the running quality. When the running speed of a paper machine becomes higher than 1000 m/min., the air flows produced by the wires greatly affect the running quality. Unless these air flows are controlled, the result is fluttering of the web, wrinkles, uneven drying, and even web breaks, with costly standstills resulting from them. The passing of the web from the press section into the drying section and the supporting of the web cannot be effectively controlled by means of the methods and devices suggested in the prior art.

It is presently the opinion in the industry that web flutter is mainly the result of strong air current flows within the pockets defined within the drying section and by pressure differentials in the pockets as well as in the nips formed by the web, drying wire and cylinder surfaces. The strong air flows and pressure differentials are the consequence of boundary layer flows induced by the moving wire, web and cylinder surfaces.

The pockets mentioned above are formed by the free web draws, free cylinder surfaces, and wires or felts guided by guide rolls. These pockets are closed except at their transverse ends and the ventilation of the pockets is considered to be an important factor from the viewpoint of efficiency and uniformity of the moisture profile obtained.

A typical arrangement between the press section and the dryer section includes the following components: a felt roll, the first dryer, the felt or fabric that supports the sheet; and the sheet itself. The problem in this arrangement is that the sheet separates from the fabric as it travels over a relatively long span between the press section and the dryer section. Since it separates, it becomes prone to wrinkles and possibly to tearing, thus causing sheet breaks. The main cause of the problem is due to machine speed. As machine speeds increase, the amount of air entrained by a fabric increases greatly. The area formed by the fabric as it comes around the felt roll is a pocket into which air is pumped, with the only escape being back through the fabric. As the air forces through the fabric in all directions, it also forces the sheet away from the fabric. The sheet can form bubbles, it can flutter and form wrinkles and break.

Some solutions proposed to alleviate this problem use high velocity jets of air to entrain surrounding air and evacuate this pocket. Any high velocity air jet has negative pressure in its wake which will cause surrounding air to be entrained with the jet. Therefore, if properly directed, this arrangement can expel air from a given area. In such typical layout, a box with high velocity jets, properly placed will evacuate much of the air being pushed through the felt and onto the paper. Although these systems work, such solution is qualitative in nature since the relationship between the nozzle flow and velocity and the amount of entrained air cannot be firmly established.

Some recently suggested solutions to these problems have allegedly been provided by the following patents:

U.S. Pat. No. 4,551,203 patented Nov. 5, 1987 by P. Eskelinen (and its corresponding Canadian Patent No. 1,243,197 issued Oct. 13, 1988) provided a method and arrangement for guiding a paper web from the press section to the drying section. The patented apparatus for guiding a fibrous web from a press section to a drying section, included a guide roll which was adapted to guide the web passing from the press section onto a drying wire from the drying section passing about the guide roll. Means were provided for urging the web and drying wire against one another as the web was passed to the drying section, the urging means being disposed between the guide roll and the drying section in a running direction of the web and wire, the guide roll constituting means for passing the web in an open draw from the press section onto the drying wire. The urging means included means for generating a negative pressure in a space adjacent a side of the drying wire opposite a side which contacted the web, to urge the web and drying wire against each other. The negative pressure generating means comprised at least one blowing box having gas discharge means extending substantially over an entire width of the web. The blowing box directed a gas stream through the gas discharge means in a direction which was substantially-parallel to the running direction of the web and supporting drying wire. The discharge speed of the gas was greater than a running speed of the drying wire. This created negative pressure between the blowing box and the drying wire in order to urge the web and drying wire against one another.

The patented method for guiding a fibrous web from a press section to a drying section, included the step of passing the web from the press section in an open draw onto a drying wire passing about a guide roll. The next step involved urging the web and drying wire against each other as the drying wire passed from the guide roll to the drying section. This urging was accomplished by ejecting gas out of blowing means on a side of the drying wire opposite to a side supporting the web in a direction which was substantially-parallel to a running direction of the drying wire and web and at a speed greater than a running speed of the drying wire in order to generate negative pressure in a space between the blowing means and the drying wire.

U.S. Pat. No. 4,694,587 patented Sep. 22, 1987 by P. Eskelinen (and its corresponding Canadian Patent No. 1,336,107 issued Aug. 08, 1995) provided a method and apparatus in a twin-wire cylinder drying section of a paper machine. The twin-wire drying section of a paper machine included upper and lower rows of drying cylinders with an upper drying wire guided by the upper drying cylinders and upper guide rolls situated between the upper drying cylinders and with a lower drying wire guided by the lower drying cylinders, and lower guide rolls situated between the lower drying cylinders. A web was pressed by the upper wire in direct drying contact with the surfaces of the upper drying cylinders and was pressed by the upper wire in direct drying contact with the surfaces of the lower drying cylinders and had a free draw of a certain length between a drying cylinder of one row and a drying cylinder of another row. A vacuum zone was arranged on a run of a drying wire between a drying cylinder and the next guide roll which caused the web to be suctioned against the drying wire so that the length of the free run of the web was substantially shortened. The suction was created by directing air jets in directions opposite to the running directions of the drying wire run and the guide roll which ejected air from spaces behind them thereby ereating the vacuum zone.

SUMMARY OF THE INVENTION

The above purported solutions do not effectively or completely solve the problem outlined. Accordingly, it is a first object of the present invention to provide a new and improved apparatus and method for guiding a fibrous web, e.g., a paper web, from a press section to a drying section, in which such web can be smoothly and securely guided in the run from the press section to the drying section.

It is another object of the present invention to provide a new and improved method and apparatus for guiding a fibrous web from a press section to a drying section, which substantially eliminates any detrimental fluttering of the web as it passes from the press section to the drying section.

It is a further object of the present invention to provide a new and improved apparatus and method for guiding a fibrous web from a press section to a drying section, in which such web is suitably guided on a suitable running support.

A still further object of the present invention is to exhaust air from the pocket which is formed by the felt, or the like, and the felt roll.

Yet a further object of the present invention is to exhaust any air carried by the felt between the felt roll and the first dryer.

A still further object of the present invention is to create a suction (negative pressure) above the felt, in the span between the felt roll and the first dryer.

The present invention provides a method for guiding a wet fibrous web from a press section to a drying section of a paper-making machine, which includes the steps of passing the wet fibrous web from the press section in an open draw onto a felt, the felt, passing about a guide roll, and urging the wet fibrous web and the felt, against each other as a drying wire of the drying section passes from the guide roll to a drying cylinder, by the generation of negative pressure in the space on the side of the felt, which is opposite to the side of the felt, which supports the fibrous web, the negative pressure being generated using the combination of (i) an inlet Venturi, which is located adjacent to the guide roll in order to draw up and exhaust air from an area where the web separates from the surface of the guide roll, (ii) an outlet Venturi which is situated adjacent to the drying cylinder to draw away air from a gap between the dryer cylinder and an inlet opening to the outlet Venturi, and (iii) a main Venturi, which is disposed between the inlet Venturi and the outlet Venturi to draw away air from, and to maintain a negative static pressure over, an unsupported span between the guide roll and the dryer cylinder.

By several features of the above-described method, the negative pressure at the inlet Venturi is generated at each of the inlet Venturi, at the outlet Venturi and at the main Venturi, by at least one of (a) at the inlet Venturi, by expelling a jet of air at a high velocity into the throat of the inlet Venturi and by discharging the jet of air angularly away from the plane of the felt, (b) at the outlet Venturi, by expelling a jet of air at a high velocity into the throat of the outlet Venturi and by discharging the jet of air angularly away from the plane of the felt, and (c) at the main Venturi, by expelling a first jet of air at a high velocity into the throat of the main Venturi, and by discharging the first jet of air perpendicularly to the plane of the felt, or by discharging the first jet of air angularly away from the plane of the felt. In step (c), negative pressure at the main Venturi may be generated by additionally expelling a second jet of air at a high velocity into the throat of the main Venturi, and by discharging the second jet of air perpendicularly to the plane of the felt, or by discharging the second jet of air angularly, away from the plane of the felt.

By still another feature of the above-described method, the primary air flow is at least one of the following: from about 50 to about 200 CFM/ft from an inlet to the outlet Venturi into the throat of the outlet Venturi; (b) of from about 50 to about 200 CFM/ft from an inlet to the inlet Venture into the throat of the inlet Venturi; and (c) of from about 50 to about 400 CFM/ft. from one inlet to the main Venturi into the throat of the main Venturi.

By still another feature of the above-described method, the distance between the web and the inlet to the inlet Venturi, and the distance between the web and the inlet to the outlet Venturi is from about ¼ inch to about ¾ inch.

BRIEF DESCRIPTION OF THE DRAWINGS

In the accompanying drawings.

DESCRIPTION OF PREFERRED EMBODIMENTS

Figure 1:
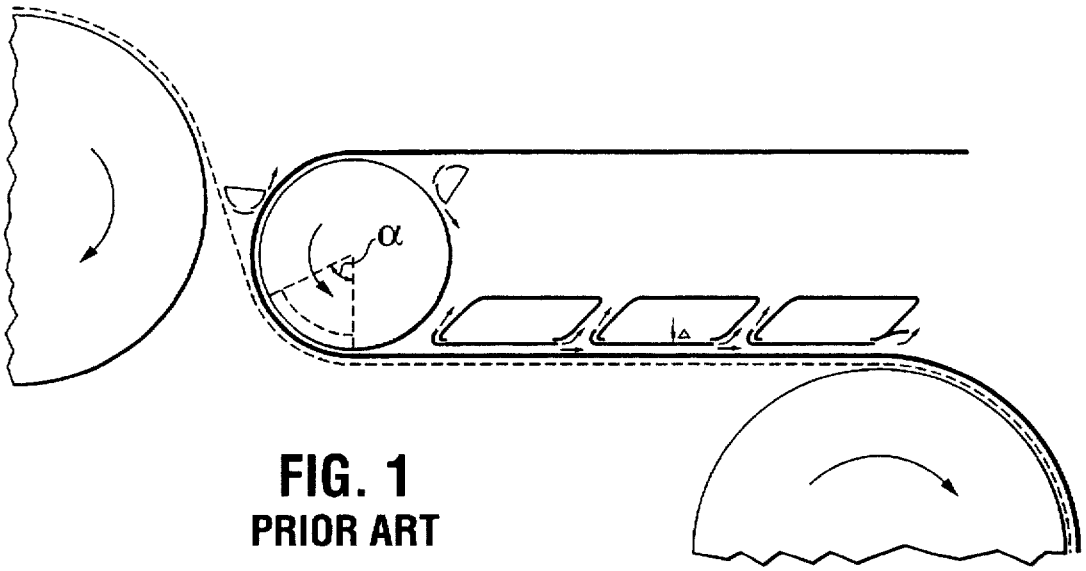
FIG. 1 PRIOR ART
FIG. 1 is a schematic view of the area of a paper machine of a typical prior art installation between the press section and the drying section.

FIG. 1 (the prior art) shows three blow FIG. 1 (the prior art) shows three blow boxes one after the other. The blow boxes each have a planar bottom face which is located at a distance Δ from the opposite drying wire. The distance Δ is preferably within the range of about 10 to about 25 mm. At both ends of the planar bottom wall of the blow boxes, nozzle slots are located, by means of which the blow jets are generated. The downstream nozzle slot of the last nozzle box is located substantially at the position at which the drying wire and the sheet achieve contact with the first drying cylinder. The fetching roll may also be arranged as a suction roll, and the suction zone a of the roll is shown in broken lines.

Additional air jets of the blow boxes are directed opposite to the direction of movement of the wire or web and of the roll. According to the prior art, it was alleged that the ejection effect of the jets prevented generation of detrimental positive pressures.

Figure 2:
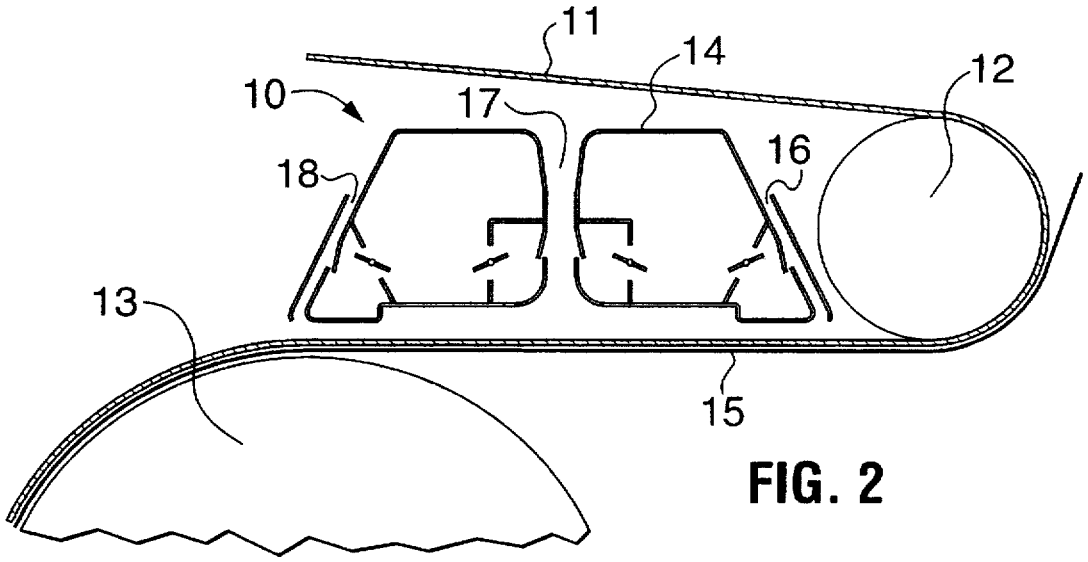
FIG. 2 is a schematic view of the area of a paper machine between the press section and the drying section according to one embodiment of the present invention.

As seen in FIG. 2, the present invention provides a sheet stabilizer 10 disposed above the felt 11 between the felt roll 12 and the first dryer cylinder 13. The sheet stabilizer is in the shape of a box 14, extending transversely across the entire width of the felt 11 and the sheet 15. The sheet stabilizer 10 is provided with an inlet Venturi 16, a main Venturi 17 and an outlet Venturi 18.

Figure 3:
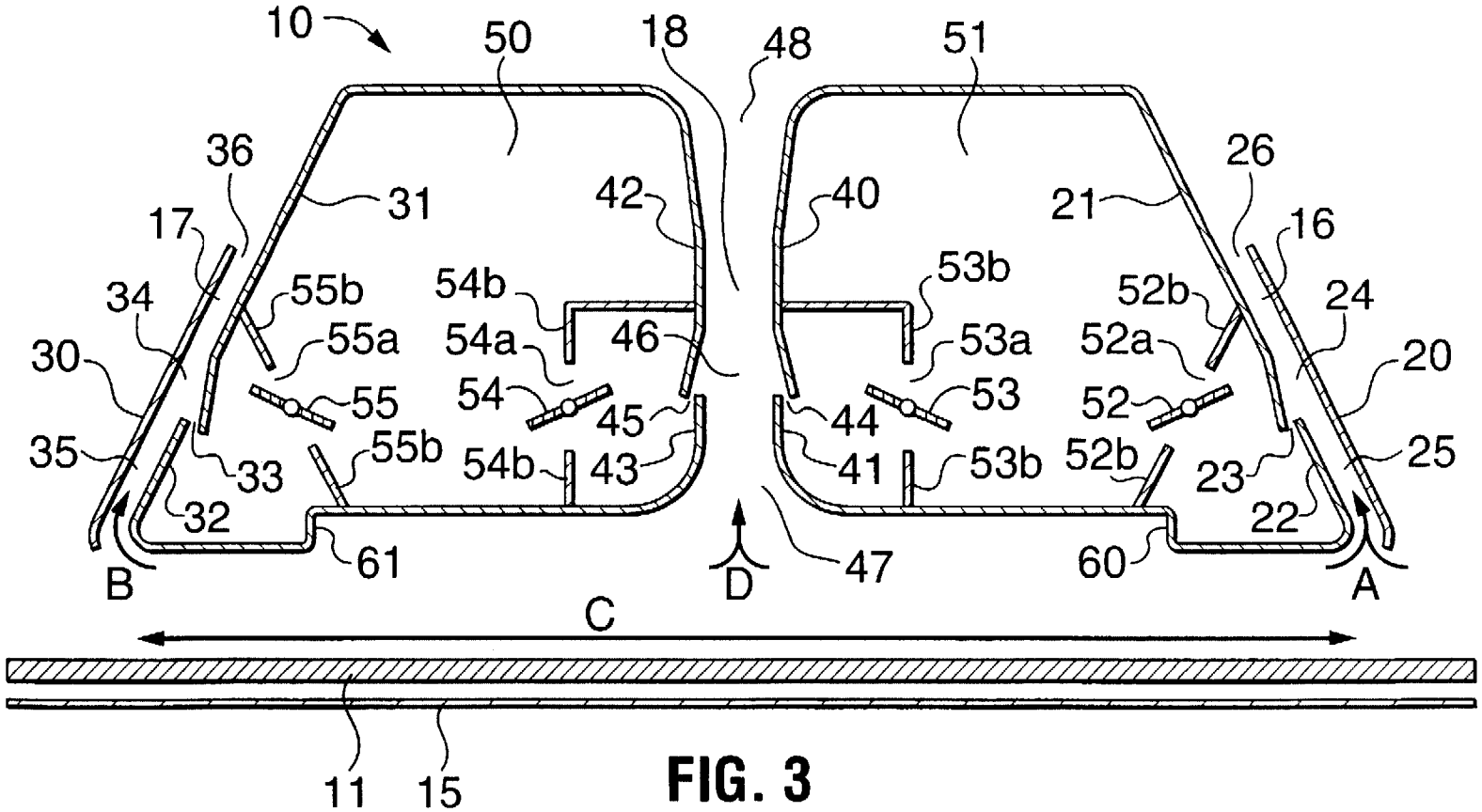
FIG. 3 is an enlarged view of the sheet stabilizer of the present invention shown in FIG. 2, and FIGS. 4 and 5 are graphs which show the performance of the sheet stabilizer.

The detailed internal structure of the sheet stabilizer 10 of FIG. 2 is shown in FIG. 3. As shown in FIG. 3, the inlet Venturi 16 is formed by the surface 20 and surfaces 21,22 which are substantially-parallel thereto. Primary air from one nozzle 23 (or from a series of nozzles) is discharged into the throat 24 which is formed by surfaces 20, and 21,22. The suction thus created draws air in through opening 25, as shown by arrows A. The combined air is discharged through inlet discharge opening 26.

Air which is carried along by the felt, or the like, 11 is exhausted through the outlet Venturi 17. The outlet Venturi 17 is formed by the surface 30 and surfaces 31,32 substantially-parallel thereto. Primary air from one nozzle 33 (or from a series of nozzles) is discharged into the throat 34 which is formed by surfaces 30 and 31,32. The suction thus created draws air in through opening 35, as shown by arrow B. The combined air is discharged through outlet discharge opening 36.

The main function of the sheet stabilizer 10 is to create a negative pressure above the felt, or the like, 11 so as to keep the sheet 15 in close contact with the felt, or the like, 11. This is primarily achieved by the main Venturi 18. Air is exhausted from the plenum C, by the main Venturi 18. The main Venturi 18 is formed by the surfaces 40,41 and 42,43. Primary air from a nozzle 44 or 45, (or from a series of such nozzles), or from both nozzles 44,45, (or from all of a series of such nozzles), is discharged into the throat 46 which is formed by surfaces 40,41 and 42,43. The suction thus created draws air in through opening 47, as shown by arrow D. The combined air is discharged through main discharge 48 opening.

The main Venturi 18, in addition, generates a negative pressure in plenum C which, in turn, creates a negative pressure over the surface of the felt 11 between the guide roll 12 and the dryer cylinder 13.

Air under pressure enters the interior 50,51 of the sheet stabilizer 10. By means of damper 52 which is operatively disposed in opening 52*a* in wall 52*b*, damper 53 which is operatively disposed in opening 53*a* in wall 53*b* in interior 51 of the sheet stabilizer 10, damper 54 which is operatively disposed in opening 54*a* in wall 54*b*, and damper 55 which is operatively disposed in opening 55*a* in wall 45*b* in interior 50 of the sheet stabilizer 10, primary air to each Venturi nozzle 23,44,45,33, (respectively), may be controlled and, thereby, the amount of exhaust and suction that is generated by the sheet stabilizer 10 can be controlled. In addition, such separate dampers 52,53,54,55 allow the modulation or biasing of the entrained air volume and suction pressure generated.

A recessed central section between forward wall 60 and rear wall 61 helps to create a plenum effect in order to enhance the effect of the negative static pressure.

Figure 4:
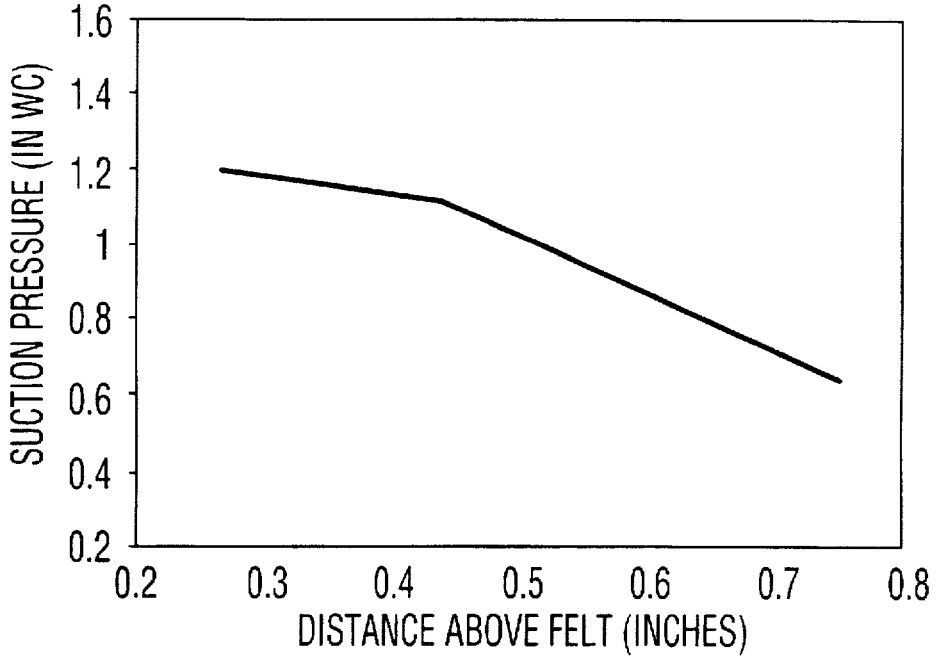

FIG. 4 shows the relationship between suction pressure and the distance between the felt, or the like, and the sheet stabilizer. Up to 1.0 inches of negative pressure can be developed with a ½" gap. This suction, however, drops off rapidly above ½". Consequently, ½" has been selected as an optimum operating point.

Figure 5:
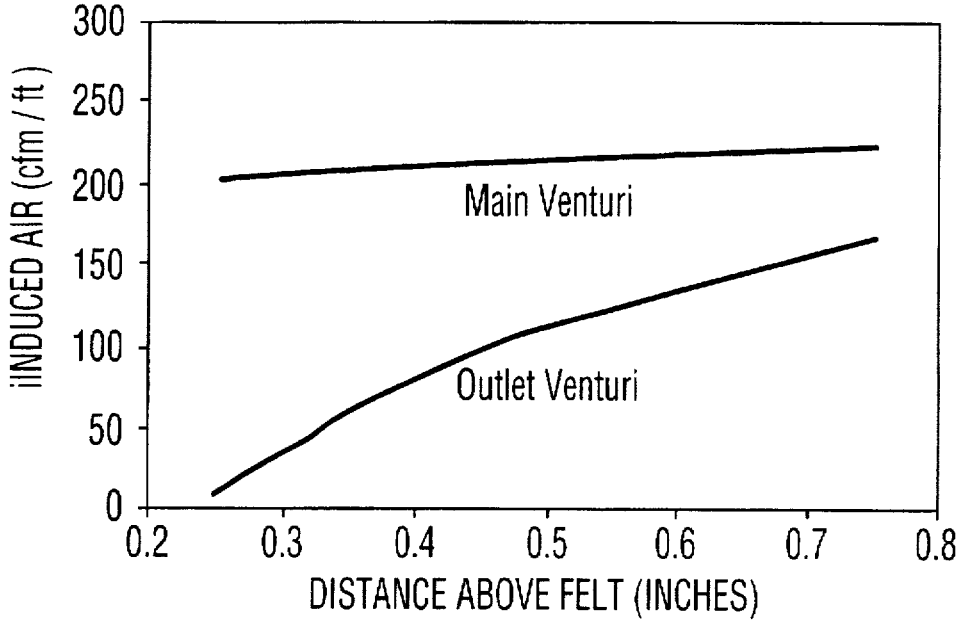

FIG. 5 shows the amount of induced air from the main Venturi as a function of the distance between the sheet stabilizer and the felt. The main Venturi has a constant air flow while the flow from the outlet Venturis increase with distance.

As described hereinabove, the aims of the present invention have been met by the sheet stabilizer which provides a direct and measurable relationship between the amount of air supplied and the amount of air entrained. This sheet stabilizer is based on the use of a Venturi. A Venturi is a device in which air with a high static pressure and low velocity is forced through a "throat" where the velocity is increased to a high level. The static pressure is converted to velocity pressure. If the velocity is high enough, the static pressure in the throat can actually become negative. Proper design of the Venturi will ensure that the desired pressure are obtained. Equations governing Venturi design are well known. A Venturi, properly designed, will have a suction that is definitive and quantitative. This suction, in turn, is used to evacuate air from above the felt, or the like, and to stabilize the sheet.

As described above, the sheet stabilizer of broad embodiments of the present invention includes three Venturis, namely an inlet Venturi, an outlet Venturi and a main Venturi. The inlet Venturi is located as close as possible to the guide roll in order to exhaust air from the area where the felt, or the like, separates from the surface of the guide roll. Air in this region would have the highest tendency to push through the felt, or the like, and would cause the initial bubbling and fluttering of the sheet.

The outlet Venturi expels a large quantity of air from the gap between the dryer cylinder and the bottom of the sheet stabilizer.

The main Venturi is also designed to expel a large quantity of air and, in conjunction with the outlet Venturi, maintains a negative static pressure over the unsupported span between the felt roll and the dryer.

The sheet stabilizer of embodiments of this invention includes dampers. Each Venturi has a separate damper which allows the modulation or biassing of the entrained air volume and suction pressure generated.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A method for guiding a wet fibrous web from a press section to a drying section of a paper-making machine, comprising the steps of:

passing said wet fibrous web from said press section in an open draw onto a felt, said felt passing about a guide roll; and urging said wet fibrous web and said felt against each other as a drying wire of said drying section passes from said guide roll to a drying cylinder, by the generation of negative pressure in the space on the side of said felt, which is opposite to the side of said felt, which supports said fibrous web;

wherein said negative pressure is generated using the combination of: (i) an inlet Venturi having an inlet opening and a throat, said inlet Venturi located adjacent to said guide roll in order to draw up and exhaust air from an area where said web separates from the surface of said guide roll: (ii) an outlet Venturi having an inlet opening and a throat, said outlet Venturi situated adjacent to said drying cylinder to draw away air from a gap between said dryer cylinder and said inlet opening of said outlet Venturi, and (iii) a main Venturi having a first and second inlet openings and throat, said main Venturi disposed between said inlet Venturi and said outlet Venturi to draw away air from, and to maintain a negative static pressure over an unsupported span between said guide roll and said dryer cylinder.

2. The method of claim 1, wherein negative pressures at said Venturis are generated at each of said inlet Venturi, said outlet Venturi and said main Venturi, by at least one of:

(a) at said inlet Venturi, by expelling a jet of air at a high velocity into the throat of said inlet Venturi and by discharging said jet of air angularly away from the plane of said felt;

(b) at said outlet Venturi, by expelling a jet of air at a high velocity into the throat of said outlet Venturi and by discharging said jet of air angularly away from the plane of said felt; and (c) at said main Venturi by expelling a first jet of air at a high velocity into the throat of said main Venturi and by discharging said first jet of air perpendicularly to the plane of said felt, or by discharging said first jet of air angularly, away from the plane of said felt.

3. The method of claim 1, wherein, in step (c), negative pressure at said main Venturi is generated by additionally expelling a second jet of air at a high velocity into the throat of said main Venturi and by discharging said second jet of air perpendicularly to the plane of said felt, or by discharging said second jet of air angularly, away from the plane of said felt.

4. The method of claim 1, wherein the primary air flow is at least one of the following:

(a) of from about 50 to about 200 CPM/ft from said inlet opening of said outlet Venturi into the throat of said outlet Venturi;

(b) of from about 50 to about 200 CFM/ft from said inlet opening of said inlet Venturi into the throat of said inlet Venturi; and (c) of from about 50 to about 400 CFM/ft. from said first inlet opening of said main Venturi into the throat of said main Venturi.

5. The method of claim 2, wherein the primary air flow is at least one of the following:

(a) of from about 50 to about 200 CFM/ft from said inlet opening of said outlet Venturi into the throat of said outlet Venturi;

(b) of from about 50 to about 200 CFM/ft from said inlet opening of said inlet Venturi, into the throat of said inlet Venturi;

(c) of from about 50 to about 400 CFM/ft. from said first inlet opening of said main Venturi into the throat of said main Venturi.

6. The method of claim 3, wherein the primary air flow is at least one of the following:

(a) of from about 50 to about 200 CFM/ft from said inlet opening of said outlet Venturi into the throat of said outlet Venturi;

(b) of from about 50 to about 200 CFM/ft from said inlet opening of said inlet Venture into the throat of said inlet Venturi; and (c) of from about 50 to about 400 CFM/ft from said second inlet opening of said main Venturi into the throat of said main Venturi.

7. The method of claim 1, wherein the distance between the web and the inlet opening of said inlet Venturi, and the distance between the web and the inlet opening of said outlet Venturi is from about ¼ inch to about ¾ inch.

8. The method of claim 2, wherein the distance between the web and the inlet opening of said inlet Venturi, and the distance between the web and the inlet opening of said outlet Venturi is from about ¼ inch to about ¾ inch.

9. The method of claim 3, wherein the distance between the web and the inlet opening of said inlet Venturi, and the distance between the web and the inlet opening of said outlet Venturi is from about ¼ inch to about ¾ inch.

10. The method of claim 4, wherein the distance between the web and the inlet opening of said inlet Venturi, and the distance between the web and the inlet opening of said outlet Venturi is from about ¼ inch to about ¾ inch.

11. The method of claim 5, wherein the distance between the web and the inlet opening of said inlet Venturi, and the distance between the web and the inlet opening of said outlet Venturi is from about ¼ inch to about ¾ inch.

12. The method of claim 6, wherein the distance between the web and the inlet opening of said inlet Venturi, and the distance between the web and the inlet opening of said outlet Venturi is from about ¼ inch to about ¾ inch.

* * * * *